US005265671A

United States Patent [19]

Vowles

[11] Patent Number: 5,265,671

[45] Date of Patent: * Nov. 30, 1993

[54] APPARATUS FOR MECHANICALLY PROJECTING DEVICES THROUGH TUBES

[75] Inventor: Robert W. Vowles, North Melbourne, Australia

[73] Assignee: Barry Brothers Specialised Service, Australia

[ * ] Notice: The portion of the term of this patent subsequent to Mar. 31, 2009 has been disclaimed.

[21] Appl. No.: 803,020

[22] Filed: Dec. 4, 1991

Related U.S. Application Data

[63] Continuation of Ser. No. 623,936, Dec. 12, 1990, Pat. No. 5,099,911.

[30] Foreign Application Priority Data

Apr. 13, 1989 [AU] Australia ..... PJ3652

[51] Int. Cl.[5] ..... F28G 1/00

[52] U.S. Cl. ..... 165/95; 15/104.05; 122/379; 122/391; 134/167 C

[58] Field of Search ..... 110/392, 379, 391; 165/95; 15/104.5; 134/167 R, 167 C

[56] References Cited

U.S. PATENT DOCUMENTS

| | | | |
|---|---|---|---|
| 3,959,840 | 6/1974 | Sato | 134/167 C |
| 4,993,443 | 2/1991 | Buchert | 134/167 C |
| 5,002,120 | 3/1991 | Boisture et al. | 165/95 |

*Primary Examiner*—Edward G. Favors

*Attorney, Agent, or Firm*—Ernest V. Linek; Robert F. O'Connell

[57] ABSTRACT

An apparatus is disclosed for projecting a stiffly flexible conduit or cable through a bore of a tube to be cleaned, surveyed or otherwise processed, said apparatus comprising a drum enabling the conduit or cable to be stored therein in a plurality of wound coils with a distal or free end of the conduit or cable to be projected from the apparatus and into the bore of the tube to be cleaned, surveyed or the like, the drum being mounted for simultaneous axial and rotary motion and drive means being provided to effect the axial and rotary motion of the drum, restraining means being provided to prevent radial expansion of the wound coils on the drum.

20 Claims, 1 Drawing Sheet

APPARATUS FOR MECHANICALLY PROJECTING DEVICES THROUGH TUBES

This is a continuation of co-pending application Ser. No. 07/623,936 filed on Dec. 12, 1990 U.S. Pat. No. 5,099,911.

The present invention relates to apparatus for projecting devices for various functions through the bores of tubes and, more specifically, tubes of smaller internal diamter and arranged in regular arrays such as those in shell and tube type heat exchangers, condensers boilers and the like.

In the operation of multi-tube industrial heat transfer units such as heat exchangers, condensers and boilers, it is often necessary to mechanically project devices into and throgh the tubes for the purposes of cleaning their internal surfaces or surveying the condition of the tubes. Such cleanint devices are commonly nozzles fitted to the ends of rigid or flexible lances and through which high velocity jets of water are directed onto the inner surfaces of the tubes for the purposes of removing fouling deposits. Devices used to survey the condition of tubes commonly involve the use of ultrasonic or eddy current methods. In most cases, said devices are manually inserted into each tube. In other cases, they may be supported on some form of positioning means which may also mechanically project them through the tubes. In almost all cases, however, such positioning and projection means are manually controlled.

Typical of devices in which the positioning and projection means are manually controlled are the Powerlance unit (U.S. Pat. No. 4,225,362), a rigid cleaning lance projection device made by Powerlance International of Houston, Tex., USA and the Bibermat unit, a flexible cleaning lance projection device made by Myers-Europe Pumpen GMBH of Essen, Federal Republic of Germany. This unit, in essence, comprises a hose with a cleaning jet nozzle that can be positioned and fed by a drive unit engaging the hose itself into and out of a tube or autoclave to be cleaned. The hose might be stored on a drum or simply collected on the ground.

The purpose of the present invention is to provide an apparatus which permits devices for cleaning, surveying or other functions to be mechanically projected through tubes arranged in regular arrays at an optimum speed and cycle frequency, the positioning and operation of said apparatus being controlled when appropriate by a stored computer program. For instance, said apparatus might position the head of a flexible cleaning lance collinear with the end of a tube, release of flow of pressurised water to said lance head and project said head through the tube at an optimum rate of travel, repeating the process if required. Alternatively, it might project a surveying device comprising an array of ultrasonic transducers through a water filled tube, withdrawing it at an optimum rate of travel whilst data on the condition of the tube is recorded by an associated data logging device.

In accordance with the present invention, there is provided apparatus for projecting a flexible lance though a bore of a tube to be cleaned, said apparatus storage member for said flexible lance having means for storing said flexible lance in a plurality of wound coils thereon with one end of said flexible lance projecting from said apparatus and adapted to be positioned in said bore of the tube, said storage member being mounted for simultaneous rotation and axial movement, and drive means to effect said rotation and axial movement of said storage member to extend said one end of said flexible lance into said tube or to withdraw said lance from said tube. It should be appreciated that the term "flexible lance" used above and throughout this specification is intended to identify any elongate flexible member that is adapted for use as a lance, an umbilical cable or the like.

Preferably, the apparatus may further include restraining means preventing radial expansion of the wound coils on the storage member. Conveniently the storage member comprises a drum having a continuous helical groove formed in an outer surface of the drum, said groove having a depth no greater than a diameter of said flexible lance, and said restraining means comprises a plurality of axially extending roller means arranged around said storage means to engage said flexible lance located in said groove over the extent of movement of said storage member.

The principal advantages of the aforesaid apparatus are minimisation of labour input, maintenance of optimum operating conditions, improved safety and reduced down time for an industrial heat transfer unit in which said apparatus is being used.

The various aspects of the present invention will be more readily understood by reference to the following description of preferred embodiments given in relation to the accompanying drawings in which.

Figure 1:
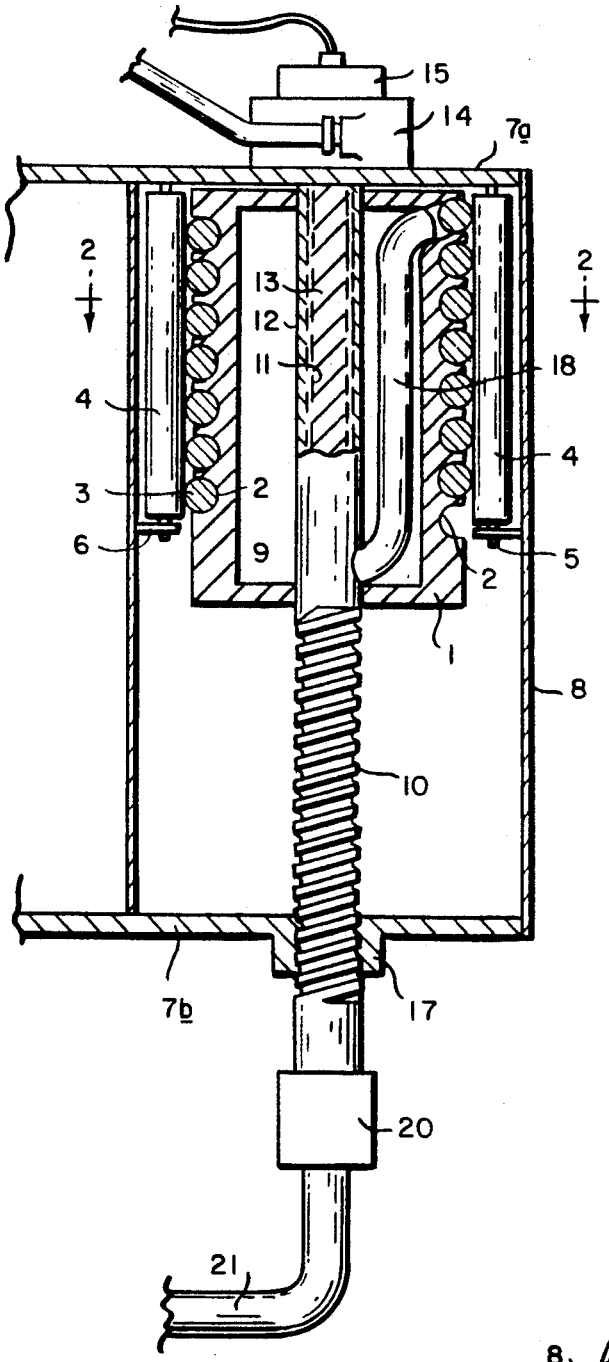
FIG. 1 is a longitudinal cross-sectional view of the apparatus.
Figure 2:
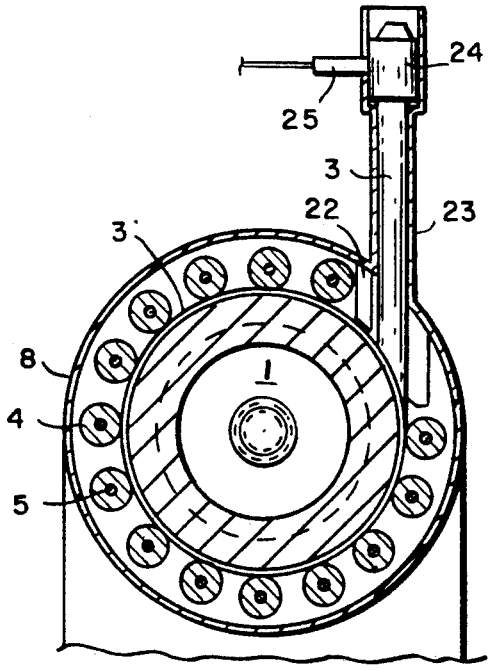
FIG. 2 is a transverse cross-sectional view of the apparatus through the centre line of its guide tube.

With reference to both FIGS. 1 and 2, drum 1 is provided on its cylindrical outer surface with a deep spiral groove 2 extending substantially throughout its axial length, depth of said groove being slightly less than the diameter of a lance or umbilical cable or the like 3 to be accommodated within it. Shaft 9 is made coaxial with said drum extending from one of its ends through its axial length and extending for at least the axial length of said drum beyond its other end. That part of said shaft accommodated within said drum is made with a hollow part 11, the inner surface of which is provided with a plurality of straight axially disposed splines 12. That part of said shaft extending beyond said drum is provided on a substantial part of its outer surface, with a coarse screw thread 10, the pitch of which is equal to that of deep spiral groove 2 on the outer surface of said drum.

Casing 8 is made cylindrical in shape and is fixed to end plates *7a* and *7b* which incorporate mounting provisions for the whole unit. Shaft 13 is provided on a substantial part of its outer surface with a plurality of straight, axially disposed splines 12 and is rotatably supported in a bearing (not shown) formed in end plate *7a*. Said splines on shaft 13 slidably (in an axial sense) engage those formed on the inner surface of hollow part 11 of shaft 9 and, with the end of drum 1 adjacent end plate *7a*, shaft 13 substantially fills said hollow part of shaft 9.

Shaft 9 is rotatably supported in threaded bearing 17 formed in end plate *7b*, said screw thread on its outer surface co-operating with a complementary screw thread formed in said bearing. That part of shaft 9 extending beyond said drum is made hollow to accommodate ducting, cabling and the like which is connected to the outer end of said shaft by suitable swivel means 20 and to which is connected supply ducting, cabling or the like 21. Said ducting, cabling or the like emerges from shaft 9 inside said drum to communicate via duct 19 with the proximal end of a lance, umbilical cable or the like 3 accommodated in said deep spiral groove on the outer surface of said drum. The proximal end of said lance, umbilical cable or the like is attached to drum 1 at the start of said deep spiral groove in its outer surface at its end adjacent end plate *7a* and passes through the thickness of said drum to communicate with its interior.

A plurality of axially disposed cylindrical rollers 4 is rotatably supported just clear of the inner surface of casing 8 upon shafts 5 carried in brackets 6 fixed to the inner surface of said casing and end plate *7a*. The diameter of said rollers and the arrangement of their supporting means is such that the outer surface of a lance, umbilical cable or the like 3 accommodated within deep spiral groove 2 of drum 1 will bear against said rollers in such a way that said lance, umbilical cable or the like is positively restrained from any radial displacement. The length of said rollers is such that, with the end of drum 1 adjacent end plate *7a*, they extend throughout the axial disposition of that part of deep spiral groove 2 in said drum in which said lance, umbilical cable or the like is accommodated.

Fixed more or less tangentially to the outer surface of casing 8 at approximately its mid length is guide tube 23 into which the distal end of a lance, umbilical cable or the like 3 is led from its accommodation in deep spiral groove 2 of drum 1. Said distal end of said lance, umbilical cable or the like terminates in a terminal unit 24 such as a cleaning head, survey unit or the like. Fixed to the outer end of said guide tube is a sensing device 25 to register withdrawal of said terminal unit into the outer end of said guide tube. Provided between the inner end of said guide tube and drum 1 is fairlead 22 to guide said lance, umbilical cable or the like from said deep spiral groove in said drum into said guide tube. Said fairlead is made of some suitable material of low frictional and high wear resistance characteristics. In an alternative embodiment, said fairlead incorporates grooved rollers to better direct said lance, umbilical cable or the like into said guide tube.

Drive motor 14 is mounted upon the outer face of end plate *7a* with its output shaft connected to shaft 13. Rotary encoder 15 is incorporated into said drive motor to enable sensing of angular displacement and angular velocity of shaft 13. Obviously a combination such as a hydraulic drive motor and a rotary encoder may be replaced by other motor and sensing device combinations or by a single electrical stepper motor of suitable characteristics.

In operation, the whole unit described is mounted by means of extensions of end plates *7a* and *7b* of casing 8 upon positioning and support means such as that described in Australian Patent No. 572,181. A stored computer program is used to drive said positioning and support means to position the outer end of guide tube 23 collinear with the end of each tube of a tube array to be cleaned or surveyed. With said outer end of said guide tube positioned collinear with a tube, said stored computer program activates valves, switches or the like to operate drive motor 14 to rotate drum 1 through a suitable angular displacement to project terminal unit 24 of lance, umbilical cable or the like 3 through the length of said tube at the desired velocity. As said drum rotates, co-operation of screw thread 10 on shaft 9 and screwed boss 17 causes said drum to be axially displaced at a rate which continuously positions the point at which lance, umbilical cable or the like 3 leaves deep spiral groove 2 of said drum adjacent the bore of fairlead 22.

Resistance against penetration of said tube encountered by terminal unit 24 of lance, unbilical cable or the like 3 during projection will result in compression forces in said lance, umbilical cable or the like. The co-operation of the outer surface of said lance, umbilical cable or the like with rollers 4 prevents any radical displacement of said lance, umbilical cable or the like from its accommodation in deep spiral groove 2 of drum 1 as a result of said compression forces.

In an alternative embodiment (not shown); shaft 13 is deleted and shaft 9 is made in one piece and extends throughout the axial length of drum 1 and beyond each of its ends by approximately a similar length. Drive motor 14 is fixed to end plate *7a* adjacent but clear of shaft 9. That part of said shaft extending outside end plate *7a* is provided on its outer surface with a plurality of straight, axially disposed splines. That part of said shaft extending beyond the other end of said drum is as previously describe. Slidably supported on said splined part of said shaft is a drive wheel, pulley or gear rotationally connected to said drive motor. Said drive wheel, pulley or gear is captured within a cage or by some other suitable restraining means such that it is free to rotate but restrained from any axial movement. In operation, rotation of shaft 9 by said drive motor driving said drive wheel, pulley or gear causes drum 1 to rotate and be axially displaced in the manner previously described whilst said splined part of said shaft moves axially through said drive wheel, pulley or gear.

In a further embodiment (not shown), either of the two arrangements described of splined shaft at the driven end of drum 1 is employed in conjunction with a plain shaft extending beyond other end of said drum rotationally supported in a plain bearing formed in end plate *7b*. One or more guide wheels, preferably but not necessarily incorporated into rollers 4, engage deep spiral groove 2 in drum 1. Alternatively, said guide wheels are rotationally fixed to the inner surface of casing 8. In operation, co-operation between said guide wheels and said deep spiral groove causes said drum to be axially displaced as said drum is rotated through the application of torque to the driven end of its supporting shaft by drive motor 14.

Obviously, instead of the external and internal splining of shaft 9 and shaft 13, shaft 13 can be made square or some other suitable cross-sectional shape and that part of shaft 9 within drum 1 can be made hollow with a complementary cross-sectional shape. Alternatively, shaft 9 can be fixed to the end of drum 1 and shaft 13 can be made to engage splines or other complementary shapes in a diametrally disposed web within drum 1.

In yet a further embodiment, to prevent any circumferential shift of said lance, umbilical cable or like on drum 1 during operation of the unit, deep spiral groove 2 is made slightly narrower than the diameter of lance 3 and, as said lance, umbilical cable or the like is wound onto said drum, in passing under the first of rollers 4, it is rolled into and frictionally captured in said deep spiral groove.

In an alternative embodiment to prevent any circumferential shift of lance, umbilical cable or the like on drum 1 during operation of the unit, shafts 5 of rollers 3 are supported in slots such that said rollers are free to move radially towards or away from said drum and spring or elastic means passing around said shafts or said rollers hold said rollers firmly in contact with the periphery of said drum or said lance, umbilical cable or the like.

In an alternative use for the invention, where it is desired to not use automated support and positioning equipment as previously described, provision can be made for the lance 3 to be fed up a flexible guide (not shown) attached to the end of guide tube 23. To the distal end of said guide tube is fitted a handpiece provided with remote controls to regulate the flow of high pressure water or other pressurised cleaning medium to said lance or flow of hydraulic fluid to hydraulic motor 14 to extend or retract said lance.

In operation, the operator positions the muzzle of said handpiece collinear with the end of a tube to be cleaned, operates the remote control to provide a flow of high pressure water or other pressurised cleaning medium to said lance and then operates the remote control to extend said lance through the length of the tube. When said lance has negotiated the length of the tube, the operator repositions the remote control to retract it and, having repositioned said handpiece collinear with the next tube to be cleaned, repeats the cycle.

I claim:

1. Apparatus for projecting a device through a bore of a tube, said apparatus comprising a storage member having means for storing a stiffly flexible conduit or cable in a plurality of wound coils thereon with a distal end of said conduit or cable projecting from said apparatus and carrying said device, drive means to effect rotation of said storage member to extend said device away from said storage member or to retract said device toward said storage member and restraining means preventing radial expansion of said wound coils on said storage member during storage or during extension or retraction of said device.

2. Apparatus according to claim 1 where in said storage member comprises a drum member and said restraining means comprises a plurality of axially extending roller means arranged around said storage means to engage said conduit or cable located on said drum member.

3. Apparatus according to claim 2 wherein said drum member includes a continuous hellical groove in an outer peripheral surface, said groove having a depth no greater than the diameter of said conduit or cable.

4. Apparatus according to claim 3 wherein said continuous helical groove has a width no greater than a diameter of said conduit or cable whereby said conduit or cable is frictionally engaged by walls of said groove.

5. Apparatus according to claim 4 wherein said roller means are free to move and are resiliently urged in a radial direction towards said storage member.

6. Apparatus according to claim 2 wherein a proximal end of said conduit or cable is connected to said storage member.

7. Apparatus according to claim 1 wherein the device comprises a nozzle or survey means.

8. Apparatus for projecting a device through a bore of a tube, said apparatus comprising a storage member having means for storing a stiffly flexible conduit or cable in a plurality of wound coils thereon with one end of said conduit or cable projecting from said apparatus and carrying said device, drive means to effect rotation of said storage member to extend said device away from said storage member or to retract said device toward said storage member and restraining means preventing radial expansion of said wound coils on said storage member during storage or during extension or retraction of said device.

9. Apparatus according to claim 8, wherein said storage member comprises a drum member and said restraining means comprises a plurality of axially extending roller means arranged around said storage means to engage said conduit or cable located on said drum member.

10. Apparatus according to claim 9, wherein said drum member includes a continuous helical groove in an outer peripheral surface, said groove having a depth no greater than the diameter of said conduit or cable.

11. Apparatus according to claim 10, wherein said continuous helical groove has a width no greater than a diameter of said conduit or cable whereby said conduit or cable is frictionally engaged by walls of said groove.

12. Apparatus according to claim 11, wherein said roller means are free to move and are resiliently urged in a radial direction towards said storage member.

13. Apparatus according to claim 8, wherein the device comprises a nozzle or survey means.

14. Apparatus for projecting a device through a bore of a tube, said apparatus comprising a storage member having means for storing a stiffly flexible conduit or cable in a plurality of wound coils thereon with a distal end of said conduit or cable carrying said device and being arranged to project through a short rigid guide member fixed adjacent to said storage member and through a longer flexible guide member connected to said short rigid guide member, said longer flexible guide member having a free distal end which is manually positionable adjacent an end of said tube, drive means to effect rotation of said storage member to extend said device away from said storage member through said guide members or to retract said device toward said storage member and restraining means preventing radial expansion of said wound coils on said storage member during storage or during extension or retraction of said device.

15. Apparatus according to claim 14, wherein said storage member comprises a drum member and said restraining means comprises a plurality of axially extending roller means arranged around said storage means to engage said conduit or cable located on said drum member.

16. Apparatus according to claim 15, wherein said drum member includes a continous helical groove in an outer peripheral surface, said groove having a depth no greater than the diameter of said conduit or cable.

17. Apparatus according to claim 16, wherein said continuous helical groove has a width no greater than a diameter of said conduit or cable whereby said conduit or cable is frictionally engaged by walls of said groove.

18. Apparatus according to claim 17, wherein said roller means are free to move and resiliently urged in a radial direction towards said storage member.

19. Apparatus according to claim 15, wherein a proximal end of said conduit or cable is connected to said storage member.

20. Apparatus according to claim 14, wherein the device comprises a nozzle or survey means.

* * * * *